US007558518B2

(12) United States Patent
Fujimoto

(10) Patent No.: US 7,558,518 B2
(45) Date of Patent: Jul. 7, 2009

(54) FIXING DEVICE FOR USE IN AN IMAGE FORMING DEVICE

(75) Inventor: Masashi Fujimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/109,996

(22) Filed: Apr. 25, 2008

(65) Prior Publication Data

US 2008/0193175 A1 Aug. 14, 2008

Related U.S. Application Data

(60) Continuation of application No. 11/896,695, filed on Sep. 5, 2007, now Pat. No. 7,383,009, which is a division of application No. 11/258,220, filed on Oct. 26, 2005, now Pat. No. 7,280,794.

(51) Int. Cl.
*G03G 15/20* (2006.01)

(52) U.S. Cl. ..... 399/328; 219/216; 399/122

(58) Field of Classification Search ..... 399/328, 399/330, 122; 219/216, 469; 347/156; 118/60
See application file for complete search history.

(56) References Cited

U.S. PATENT DOCUMENTS 5,459,553 A * 10/1995 Kim ..... 399/20
5,659,848 A * 8/1997 Jeon ..... 399/122
5,991,572 A * 11/1999 Cho ..... 399/122
6,122,480 A * 9/2000 Hwang ..... 399/328 X
6,551,008 B1 * 4/2003 Uchiyama ..... 403/353
7,009,158 B2 * 3/2006 Sekiguchi et al. ..... 219/216 X
2002/0124788 A1 * 9/2002 Hobdy ..... 114/230.12
2005/0099769 A1 * 5/2005 Bleau et al. ..... 361/690

FOREIGN PATENT DOCUMENTS

JP 05-312211 A * 11/1993

* cited by examiner

*Primary Examiner*—Sophia S Chen
(74) *Attorney, Agent, or Firm*—Global IP Counselors, LLP

(57) ABSTRACT

A fixing roller 30, which has an internal heating device and is supported to rotate around a cylindrical shaft 40, and a pressure roller 81 whose circumferential face presses against the fixing roller 30, and which is supported to rotate around the pressure roller axle 82, are mounted in a housing 11, so that, by passing paper P to which a toner image has been transferred, a fixing process is performed on this toner image. The fixing roller 30 is mounted in the housing 11 by heat resistant bushings 50, which are fitted on both ends of the cylindrical shaft 40. Annular grooves 41 are arranged on the cylindrical shaft 40 for receiving C-shaped retaining rings 70, for preventing the heat resistant bushings 50 from coming off. The heat resistant bushings 50 and the retaining rings 70 engage with each other to rotate in unison around the cylindrical shaft 40.

8 Claims, 4 Drawing Sheets

FIXING DEVICE FOR USE IN AN IMAGE FORMING DEVICE

CROSS-REFERENCE TO RELATED APPLICATIONS

This application is a continuation application of U.S. patent application Ser. No. 11/896,695 filed on Sep. 5, 2007, and allowed on Feb. 1, 2008, and this parent application is a divisional application of U.S. patent application Ser. No. 11/258,220, filed on Oct. 26, 2005, and issued on Oct. 9, 2007. The entire disclosure of U.S. patent application Ser. Nos. 11/896,695 and 11/258,220 is hereby incorporated herein by reference.

BACKGROUND OF THE INVENTION

1. Field of the Invention

The present invention relates to a fixing device for use in image forming devices such as copiers and facsimile devices, as well as in various types of printers.

2. Background Information

Image forming devices normally have a basic structure comprising a photosensitive drum, on the circumferential face of which an electrostatic latent image is formed based on image information from a document image which is read and/or electronically transmitted thereto, a developing device for forming a toner image on the circumferential face of this photosensitive drum by supplying toner to this circumferential face, a transport device for transporting and transferring the toner image that has been formed on the circumferential face of the photosensitive drum by the developing device to paper, and a fixing device for performing a fixing process on the toner image that has been transferred onto the paper.

The fixing device comprises a fixing roller provided with a heating means for generating heat by passing electric current therethrough, and a pressure roller disposed so that the circumferential face thereof faces and presses against the circumferential face of this fixing roller, the process of fixing the toner image on the paper being performed by heating the paper on which the toner image has been transferred with the fixing roller while causing the paper to pass through a nip formed between the fixing roller and the pressure roller, both of which are rotating.

FIG. 5 is an end-on perspective view showing one example of a conventional fixing roller member 100; as shown in this figure, the conventional fixing roller member 100 comprises a cylindrical shaft (fixing roller axle) 101; a retaining ring 103, in the form of a C-ring, which engages in an annular groove 102 that is practiced on the outer circumferential face of the end of this axle member 101; a heat resistant bushing 104, which is made of synthetic resin and fits rotatably on the cylindrical shaft 101, to the inside of this retaining ring 103; a bearing 105, having an inner ring 105*a*, which fits on this heat resistant bushing 104; and a fixing roller 106, which is formed integrally with the cylindrical shaft 101 at a position to the inside of the bearing 105 (which is to say at the center of the cylindrical shaft 101, in the lengthwise direction thereof). The outer rings 105*b* of the bearings 105 are supported by side walls of a fixing device housing, which is not shown in the drawing, whereby this fixing roller member 100 can rotate in unison with the rotation of the cylindrical shaft 101, when driven by a pressure roller, which is not shown in the drawing, within this housing.

Here, in conventional developing devices having a fixing roller member 100 such as described above, there was a problem in that the various parts thereof expand as a result of heating by the heating means provided within the cylindrical shaft 101 and, as the coefficients of expansion and the thermal capacity of the various parts differ from one to the other, it may happen that, depending on circumstances, the internal diameter of the heat resistant bushing 104 becomes larger than the external diameter of the cylindrical shaft 101, and under these circumstances, it is possible that, while the retaining ring 103 rotates in unison with the cylindrical shaft 101, the heat resistant bushing 104 does not rotate.

Then, if the retaining ring 103 rotates while the heat resistant bushing 104 is not rotating, the end of the C-ring shaped retaining ring 103 cuts the surface of the heat resistant bushing 104, which is made from synthetic resin, as a result of which, because of the increased internal diameter of the heat resistant bushing 104, the heat resistant bushing 104 comes off from the cylindrical shaft of 101 (which is to say that the fixing roller 106 falls out of the bearing 105).

In the foregoing, conventional problems were described for a situation in which the heat resistant bushing 104 ceases to rotate readily in unison with the cylindrical shaft 101, but similar problems arise when the retaining ring 103 ceases to rotate readily in unison with the cylindrical shaft 101.

SUMMARY OF THE INVENTION

The present invention is directed at resolving problems such the aforementioned ones, and an object thereof is to provide a fixing device capable of reliably preventing the heat resistant bushing from falling off of the fixing roller shaft by ensuring that the bushing and the retaining ring rotate in unison under all circumstances.

The present invention according to a first aspect is a fixing device, in which a fixing roller, having an internal heating means, and which is supported so as to be able to rotate around, and in unison with, a fixing roller axle, and a pressure roller, having a circumferential face which is pressed against the fixing roller in the lengthwise direction, along substantially the entire length thereof, and which is supported so as to be able to rotate around a pressure roller axle, are mounted in a predetermined housing, for performing a fixing process on a toner image by passing paper, to which the toner image has been transferred, between the fixing roller and the pressure roller, comprising: a bushing fitted on the ends of the fixing roller for mounting the fixing roller in the housing; and a C-shaped retaining ring having a gap, for fitting into the fixing roller axle and preventing the bushing from coming off, the bushing and the retaining ring engaging with each other so as to be able to rotate in unison around the fixing roller axle.

By adopting such a constitution, even if, for example as a result of thermal expansion of the bushing caused by heat from the heating means, the internal diameter of the bushing becomes larger then the diameter of the fixing roller axle, which results in the bushing and the cylindrical shaft ceasing to rotate in unison, the bushing and the retaining ring always rotate in unison because the bushing and the retaining ring are engaged with each other so as to be able to rotate in unison around the fixing roller axle. Accordingly, conventional problems do not arise such as those wherein the bushing comes off of the fixing roller axle and the fixing roller axle falls out because of increases in the internal diameter of the heat resistant bushing, which is caused by the surface of the heat resistant bushing being cut by the ends of the C-shaped retaining ring, as a result of the bushing not rotating with respect to the rotation of the retaining ring, which is brought about by the rotation of the fixing roller when driven by the pressure roller. Furthermore, even in situations where the retaining ring has ceased to rotate in unison with the fixing roller axle, the same effect is provided as with the bushing.

The present invention according to a second aspect is the invention according to the first aspect, wherein the bushing is fitted on the outer ring of a bearing.

By adopting such a constitution, the fixing roller can rotate smoothly around the fixing roller axle and in unison therewith by supporting the outer rings of the bearings at suitable places in the housing.

The present invention according to a third aspect is the invention according to the first aspect, wherein each of the bushing and the retaining ring has a gap of a predetermined width, which is formed by cutting in the axial directions thereof.

By adopting such a constitution, the bushing and the retaining ring are able to flexibly respond to thermal expansion due to the heating by way of the presence of this gap.

The present invention according to a fourth aspect is the invention according to the third aspect, wherein the bushing comprises a bushing side protrusion for fitting into the gap in the retaining ring.

By adopting such a constitution, it is possible to ensure that the bushing and the retaining ring rotate in unison around the fixing roller axle, because the bushing side protrusion that is provided on the bushing fits into the gap in the retaining ring.

The present invention according to a fifth aspect is the invention according to the third aspect, wherein the retaining ring comprises a retaining ring side protrusion for fitting into the gap in the bushing.

By adopting such a constitution, it is possible to ensure that the bushing and the retaining ring rotate in unison around the fixing roller axle, because the retaining ring side protrusion that is provided on the retaining ring fits into the gap in the bushing.

By virtue of the invention according to the first aspect, even if the internal diameter of the bushing becomes larger than the diameter of the fixing roller axle due to the thermal expansion of the bushing as a result of heating by the heating means, and as a result the bushing and the fixing roller cease to rotate in unison, the bushing and the retaining ring always rotate in unison because the two are engaged so as to be able to rotate in unison around the fixing roller axle. Accordingly, it is possible to reliably prevent increases in the internal diameter of the bushing resulting from the surface of the bushing being cut by the ends of the C-shaped retaining ring as a result of the bushing not rotating with respect to the rotation of the retaining ring, which is brought about by the rotation of the fixing roller when driven by the pressure roller. Thus, it is possible to reliably prevent problems such as the bushing coming off of the fixing roller axle due to increases in the internal diameter of the bushing, whereby the fixing roller cannot be used, and consequently to contribute to reductions in the maintenance costs for the fixing device. Furthermore, even in situations where the retaining ring has ceased to rotate in unison with the fixing roller axle, the same effect is provided as with the bushing.

By virtue of the invention according to the second aspect, because the inner ring of the bearing is fitted on the bushing, by supporting the outer ring of the bearing at a suitable place in the predetermined housing, it is possible to install the fixing roller on the predetermined housing of the developing device while the fixing roller is able to rotate smoothly around the fixing roller axle, so that in addition to ensuring smooth rotation of the fixing roller, it is possible to simplify the structure for supporting the fixing roller in the housing.

By virtue of the invention according to the third aspect, because each of the bushing and the retaining ring has a gap of a predetermined width, formed by cutting in the axial directions thereof, the bushing and the retaining ring can flexibly respond to thermal expansion resulting from heating, by way of the presence of these gaps, and it is easily possible to mount them on, and remove them from, the fixing roller axle, by elastically deforming them at the gap.

By virtue of the invention according to the fourth aspect, because a bushing side protrusion is provided on the bushing, which fits into the gap in the retaining ring, as a result of the bushing side protrusion fitting into the gap in the retaining ring, it is possible to ensure that the bushing and the retaining ring rotate in unison around the fixing roller axle and, in addition to simplifying the unified rotational structure of the bushing and the retaining ring, the two are made to rotate reliably in unison at all times.

By virtue of the invention according to the fifth aspect, because a retaining ring side protrusion is provided on the retaining ring, which fits into the gap in the bushing, as a result of the retaining ring side protrusion fitting into the gap in the bushing, it is possible to ensure that the bushing and the retaining ring rotate in unison around the fixing roller axle and, in addition to simplifying the unified rotational structure of the bushing and the retaining ring, the two are made to rotate reliably in unison at all times.

BRIEF DESCRIPTION OF THE DRAWINGS

Referring now to the attached drawings which form a part of this original disclosure:

FIG. 3A is an exploded perspective view, and FIG. 3B is a partially cut away assembly perspective view.

FIG. 4A is an exploded perspective view, and FIG. 4B is an assembly perspective view.

DETAILED DESCRIPTION OF THE PREFERRED EMBODIMENTS

Figure 1:
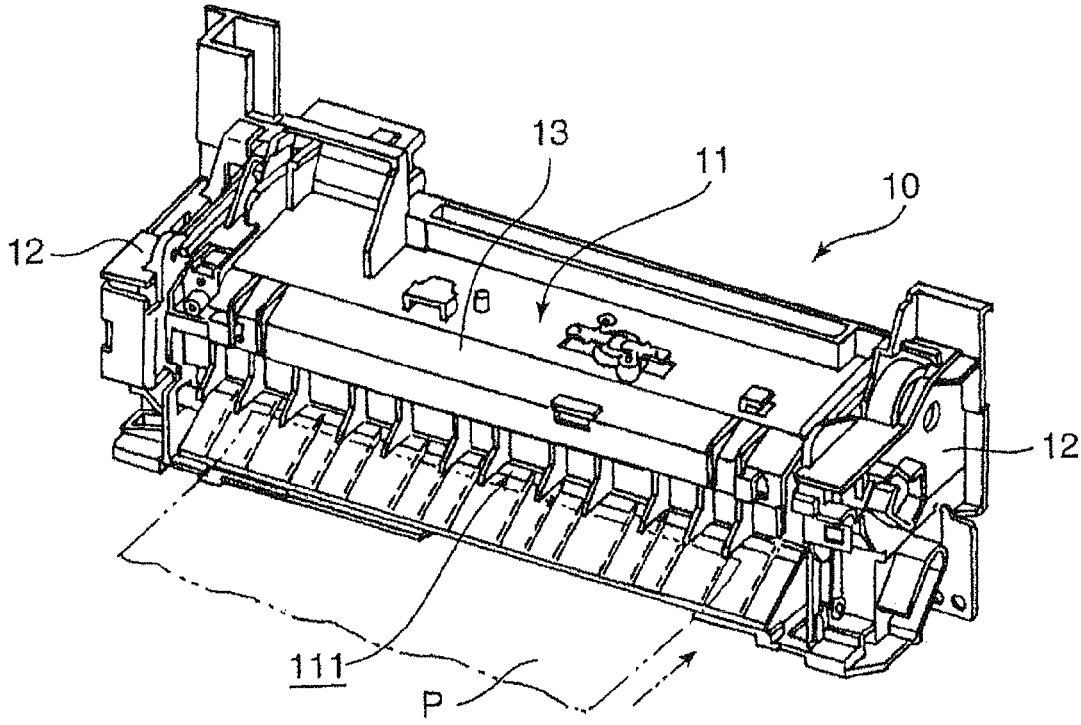
FIG. 1 is a perspective view illustrating one mode of embodiment of a fixing device according to the present invention.
Figure 2:
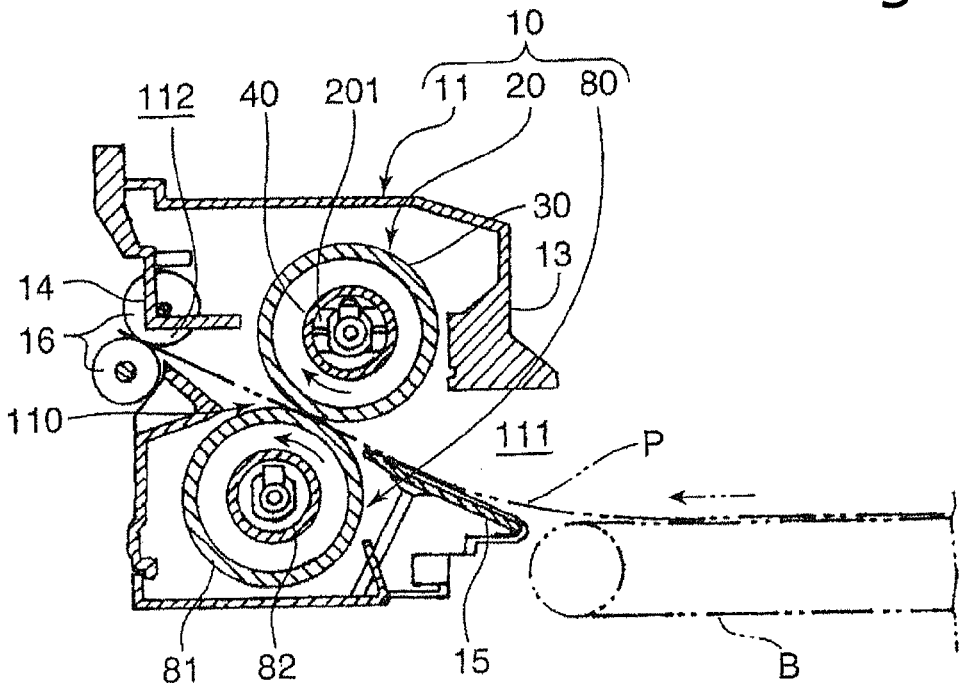
FIG. 2 is a schematic sectional view, as seen from the side, of the fixing device shown in FIG. 1.

FIG. 1 is a perspective view illustrating one mode of embodiment of the fixing device according to the present invention; and FIG. 2 is a sectional view thereof as seen from the side. As shown in these figures, a fixing device 10 has a basic structure comprising a housing 11, having a substantially rectangular shape that is laterally elongate (in the horizontal direction orthogonal to the direction of transport of paper P, as indicated by the arrow); a fixing roller member 20 installed between laterally facing side walls 12 of the housing 11; and a pressure roller member 80 installed between the pair of side walls 12 below this fixing roller member 20 so that the circumferential faces thereof are pressed into close contact with each other.

At a portion where the circumferential face of the fixing roller member 20 and the circumferential face of the pressure roller member 80 are pressed into close contact is formed a nip 110 for nipping the paper P. Then, a heating means 201 consisting of a body that generates heat when electrical current passes therethrough such as, for example, a halogen lamp, is provided within the fixing roller member 20 (more specifically, within the cylindrical shaft 40 described herein below), and the fixing roller member 20 is heated by supplying electricity to this heating means 201. Furthermore, when the pressure roller member 80 is driven rotationally in the counterclockwise direction in FIG. 2 around the axis thereof by driving a drive motor, which is not shown in the drawing, the fixing roller member 20, having a circumferential face which presses against the circumferential face of the pressure roller member 80, is driven by the rotation of the pressure roller member 80 and rotates in the clockwise direction in FIG. 2 around the axis thereof.

The laterally elongate paper feed opening 111 is practiced in the housing 11, at a position somewhat below the vertical center of an upstream wall 13, for feeding paper P, which is transported thereto by a transport belt B, and onto which a toner image has been transferred, to the nip 110 in the housing 11, while a laterally elongate paper output opening 112 is practiced at a position somewhat above the vertical center of a downstream wall 14, for outputting to the exterior of the system the paper P on which fixing processing has been performed by the fixing roller member 20.

A laterally elongate guide plate 15 is provided below the paper feed opening 111, which is inclined upwards towards the nip 110, and a pair of output rollers 16 is provided at the output opening 112 for outputting the paper P from the nip 110 to the exterior of the system. Thus, the paper P that is delivered to the paper feed opening 111 from the transport belt B, is fed to the nip 110, by way of guiding by the guide plate 15, where it is transported towards the output opening 112 by the rotations of the fixing roller member 20 and the pressure roller member 80, which rotate around their axes in mutually opposite directions of rotation, whereupon it is heated by the fixing roller member 20 so as to undergo a toner image fixing process, and output to the exterior of the system by way of the pair of output rollers 16.

Figure 3A:
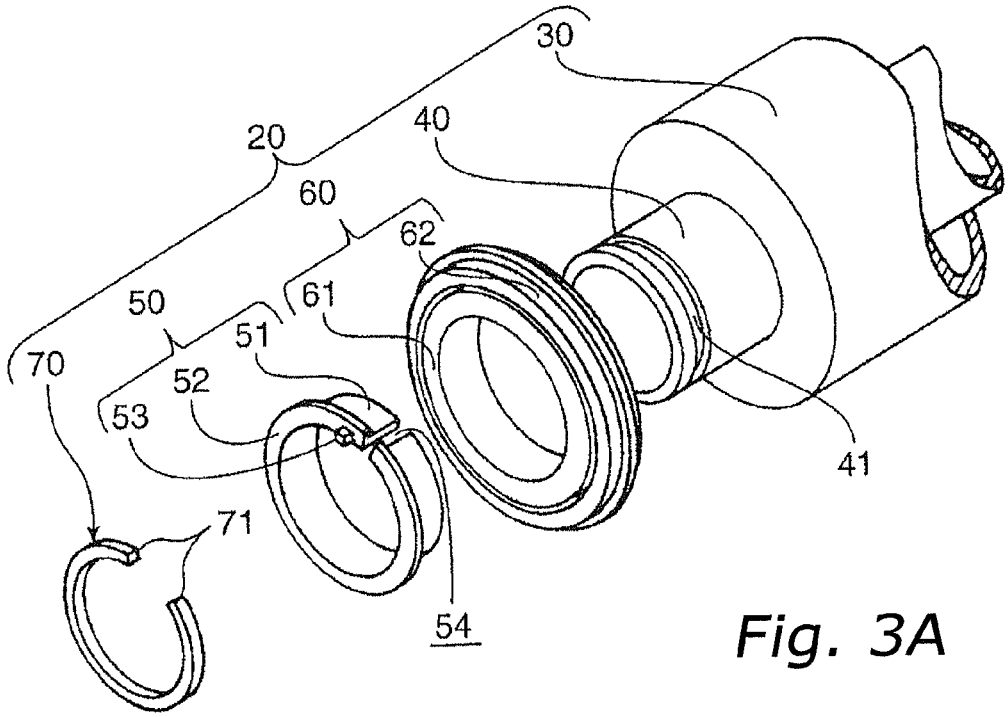
FIG. 3A and FIG. 3B are prospective views illustrating a first mode of embodiment of a fixing roller member.
Figure 3B:
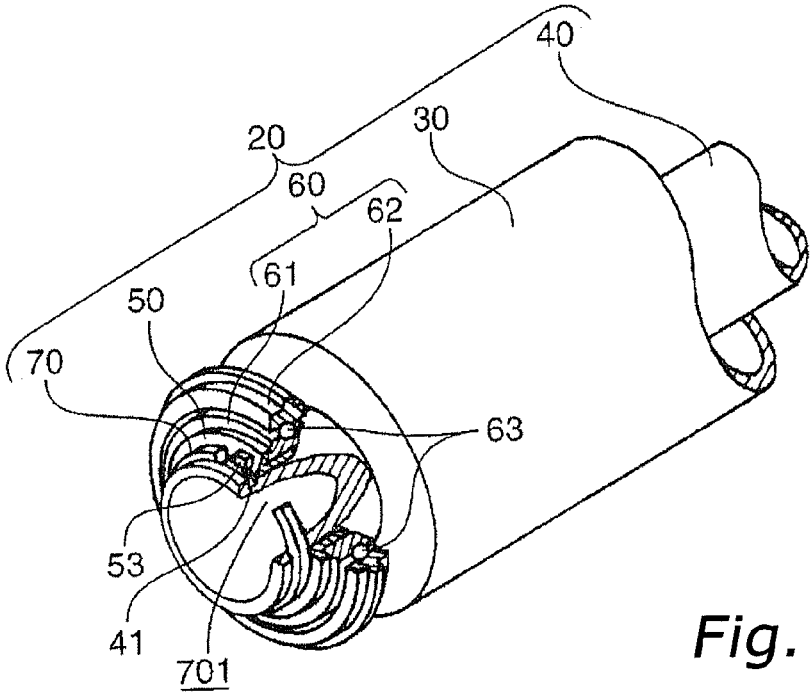

FIG. 3A and FIG. 3B are perspective views illustrating a first mode of embodiment of the fixing roller member 20; FIG. 3A being an exploded perspective view, and FIG. 3B being a partially cut away assembly perspective view. First, as shown in FIG. 3A, the fixing roller member 20 comprises a fixing roller 30, a cylindrical shaft (fixing roller axle) 40, on which this fixing roller 30 is concentrically and rigidly fitted; heat resistant bushings 50, which are fitted on this cylindrical shaft 40; ball bearings 60, which are fitted on these heat resistant bushings 50; and retaining rings 70, which are fitted on the ends of this cylindrical shaft 40, so as to prevent the heat resistant bushings 50 from coming off.

The length of the fixing roller 30 is established somewhat shorter in the lengthwise direction than that of the cylindrical shaft 40, whereby with the fixing roller 30 fitted on the cylindrical shaft 40, both ends of the cylindrical shaft 40 protrude to the exterior beyond both sides of the fixing roller 30, so that it is possible to mount the heat resistant bushings 50, the ball bearings 60 and the retaining rings 70 on these outwardly protruding portions. Annular grooves 41 are practiced on the outer circumferential faces of the ends of the cylindrical shaft 40, and the retaining rings 70 engage in these annular grooves 41, so as to be prevented from coming off.

The heat resistant bushing 50 has heat resistant properties and is formed from a silicon resin, a fluorine resin such as PTFE (polytetrafluoroethylene), or PEEK (polyether ether ketone), and consists of a bushing main body 51, which is closely fitted to the exterior circumferential face of the cylindrical shaft 40, a flange 52, which protrudes radially outward along the entire circumference of the exterior rim of this bushing main body 51, and a projection (bushing side protection) 53, which projects outwards from the exterior side of the flange 52. The diameter of this bushing main body 51 is established so that the interior diameter is slightly smaller than the exterior diameter of the cylindrical shaft 40.

Such a heat resistant bushing 50 comprises a gap 54 formed by cutting a part of the ring, so that the heat resistant bushing 50 is able to respond to expansion and contraction of the cylindrical shaft 40 (thermal expansion, and contraction with cooling) by way of changes in the size of this gap 54.

The ball bearings 60 are disposed between the heat resistant bushings 50 and the sidewall 12 of the housing 11, and comprise an inner ring 61, which is force-fitted onto the bushing main body 51 and an outer ring 62, which is fitted on the inner ring 61 with play therebetween by way of a plurality of steel balls 63 (FIG. 3B). The inner ring 61 is established so that the internal diameter thereof is slightly smaller than the external diameter of the bushing main body 51, when this is fitted on the cylindrical shaft 40; and by forcing the bushing main body 51 that is fitted on the cylindrical shaft 40 into the inner ring 61, the inner ring 61 is mounted on the cylindrical shaft 40 so as to rotate in unison with the fixing roller 30, by way of the heat resistant bushing 50. This inner ring 61 is prevented from coming off to the exterior of the bushing main body 51 by restraining it with the flange 52 of the heat resistant bushing 50.

The retaining ring 70 is formed in the shape of a letter C by cutting out a portion of a ring, so as to form a so-called C-ring; the interior diameter thereof is established at slightly smaller than the groove diameter at the bottom of the annular groove 41 on the cylindrical shaft 40, the external diameter thereof being established at somewhat larger than the external diameter of the cylindrical shaft 40, whereby, when fitted in the annular groove 41, the external circumferential edge thereof protrudes to the exterior of the annular groove 41, as shown in FIG. 3B.

Then, the protrusion 53 on the heat resistant bushing 50 is set in a mounting position located between the facing ends 71 of the retaining ring 70 when the retaining ring 70 is fitted in the annular groove 41. Accordingly, with the heat resistant bushing 50 fitted to the inward side of the annular groove 41 in the cylindrical shaft 40 and the retaining ring 70 fitted in the annular groove 41, the protrusion 53 on the heat resistant bushing 50 is positioned in the gap 701 between the facing ends 71 of the retaining ring 70, as shown in FIG. 3B, whereby the heat resistant bushing 50 and the retaining ring 70 rotate in unison around the cylindrical shaft 40 as a result of the protrusion 53 engaging with the ends 71 of the retaining ring 70.

The fixing roller member 20 having this constitution is such that, by fixing the outer ring 62 of the ball bearing 60 in the sidewall 12 of the housing 11, the fixing roller 30 is mounted in the housing 11 so as to be able to rotate around, and in unison with, the cylindrical shaft 40 by way of the ball bearing 60.

As shown in FIG. 2, the pressure roller member 80 comprises a pressure roller 81, which is disposed facing the fixing roller 30, so that the circumferential face thereof is pressed against the circumferential face of the fixing roller 30, and pressure roller axle 82 that is formed integrally with, and concentric with, this pressure roller 81. With the pressure roller axle 82 installed between the pair of sidewalls 12 (FIG. 1) of the housing 11, it can be rotationally driven around the axis thereof by a drive motor, which is not shown in the drawing. Then, by rotationally driving the pressure roller 81 around the pressure roller axle 82 in the counterclockwise direction in the FIG. 2, the fixing roller 30, having a circumferential face that presses against the circumferential face of the pressure roller 81 at the nip 110, is rotationally driven in the clockwise direction around the cylindrical shaft 40. Accordingly, the paper P that is fed to the nip 110 from the transport belt B, by way of the guide plate 15, is output to the exterior of the housing 11 by way of the pair of output rollers 16, while a process for fixing the toner image is performed by the heat of the fixing roller 30.

According to the fixing device 10 of the first mode of embodiment, which is constituted as described above, the driven rotation of the fixing roller 30 is transmitted to the inner ring 61 of the ball bearing 60 by way of the cylindrical shaft 40 and the heat resistant bushing 50, whereby this rotates smoothly around the axis thereof in a corresponding rotation, with respect to the outer ring 62 by way of the steel balls 63 on the inner ring 61. Then, if for example a situation arose wherein the retaining ring 70 or the heat resistant bushing 50 ceased to rotate around the axis for some reason, because the protrusion 53 that is provided on the heat resistant bushing 50 is located between the pair of ends 71 of the retaining ring 70, if either one of the heat resistant bushing 50 or the retaining ring 70 were to rotate, that rotational force would be transferred to the other one by the protrusion 53, and both would turn together.

Accordingly, it is possible to reliably prevent problems such as the outer side wall of the flange 52 on the heat resistant bushing 50 being cut by the ends 71 of the retaining ring 70 as a result of only one of the heat resistant bushing 50 or the retaining ring 70 rotating, whereby it is possible to reliably prevent resulting problems such as the ball bearing 60 passing over the retaining ring 70 and coming off from the cylindrical shaft 40.

Figure 4A:
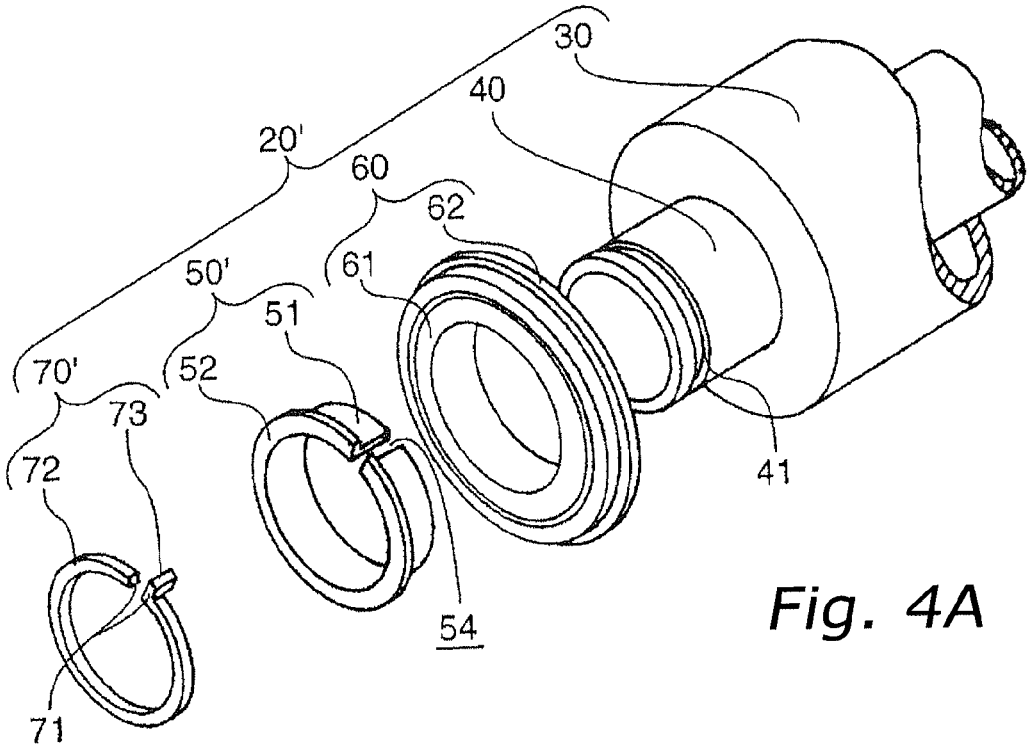
FIG. 4A and FIG. 4B are prospective views illustrating a second mode of embodiment of a fixing roller member.
Figure 4B:
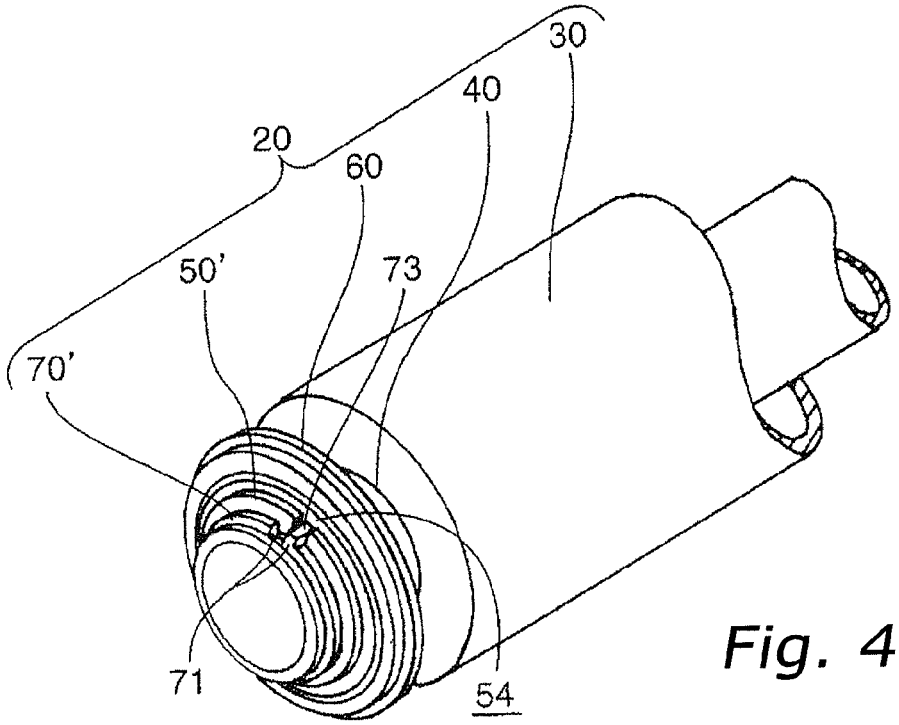
Figure 5:
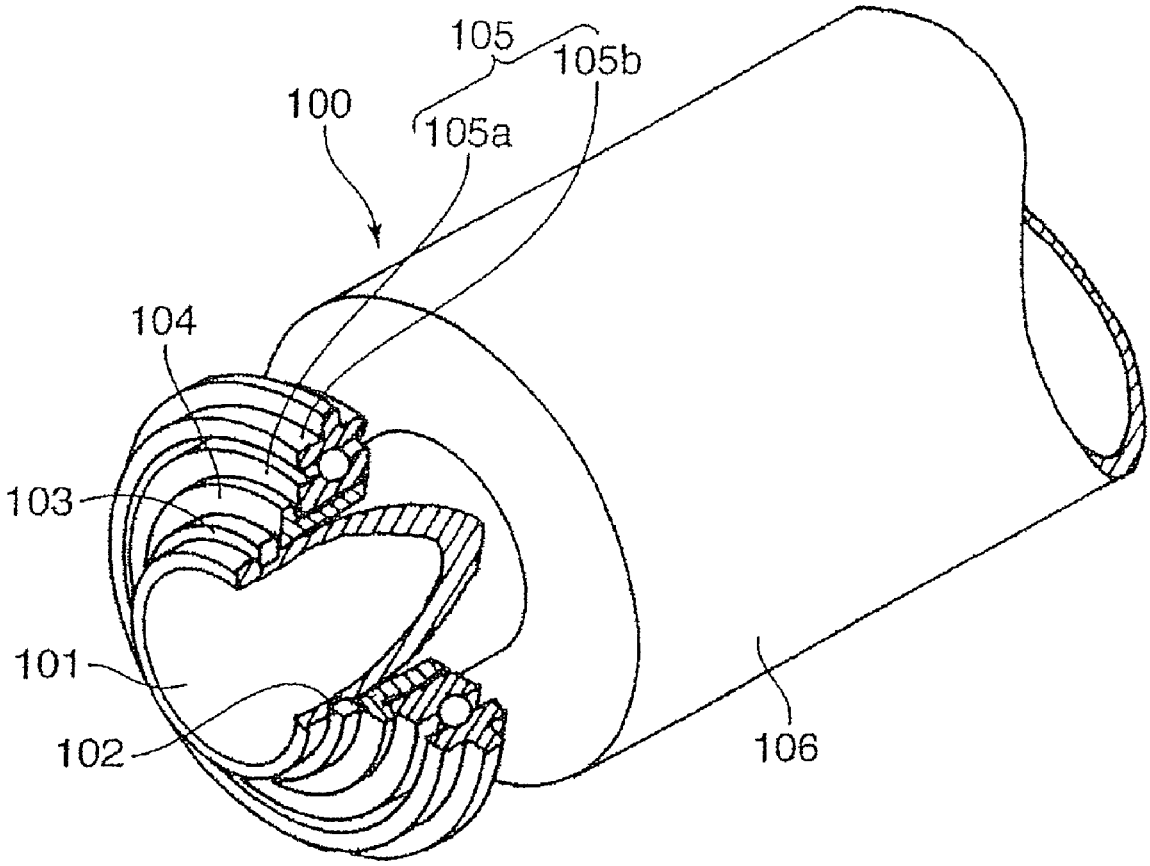
(Prior Art) Fig. 5
FIG. 5 is a perspective view showing an example of a conventional fixing roller member.

FIG. 4A and FIG. 4B are perspective views illustrating a fixing roller member 20' in a second mode of embodiment; FIG. 4A is an exploded perspective view and FIG. 4B is an assembly perspective view. The fixing roller member 20' of the second mode of invention differs from the fixing roller member 20 of the first mode of embodiment in that a protrusion 53 is not provided on the heat resistant bushing 50' and in that the retaining ring 70' comprises a retaining ring main body 72 and a protruding tab (retaining ring side protrusion) 73 that projects towards the exterior from one end 71 of this retaining ring main body 72, so as to protrude in the direction of a gap 54 in the heat resistant bushing 50'. Otherwise, the fixing roller 30, the cylindrical shaft 40 and the ball bearing 60 are the same as in the first mode of embodiment.

According to the fixing roller member 20' of the second mode of embodiment, when this fixing roller member 20' is mounted, as shown in FIG. 4B, the protruding tab 73 on the retaining ring 70' fits into the gap 54 in the heat resistant bushing 50' (the two parts engage with each other), whereby the heat resistant bushing 50' and the retaining ring 70' rotate around the axis of the cylindrical shaft 40 in unison, allowing for the same effect as with the fixing roller member 20 of the first mode of embodiment.

As described above, the fixing device 10 of the present invention has a constitution wherein a fixing roller 30, having an internal heating means 201, and which is supported so as to be able to rotate around the cylindrical shaft 40 in unison therewith, and a pressure roller 81 having a circumferential face which presses against the fixing roller 30 in the lengthwise direction along substantially the entire length thereof, and which is supported so as to be able to rotate around the pressure roller axle 82, are mounted in a predetermined housing 11, so that, by passing paper P, onto which a toner image has been transferred, between the fixing roller 30 and the pressure roller 81, a fixing process is performed on this toner image; the fixing roller 30 is mounted in the housing 11 by way of heat resistant bushings 50, 50', which are fitted on both ends of the cylindrical shaft 40; annular grooves 41 are practiced on the cylindrical shaft 40 for receiving C-shaped retaining rings 70, 70', for preventing the heat resistant bushings 50, 50' from coming off, the heat resistant bushings 50, 50' and the retaining rings 70, 70' engage with each other so as to be able to rotate in unison around the cylindrical shaft 40, whereby even if, for example as a result of thermal expansion of a heat resistant bushing 50, 50' caused by heat from the heating means 201, the internal diameter of the heat resistant bushing 50, 50' becomes larger than the diameter of the cylindrical shaft 40, so that the heat resistant bushing 50, 50' and the cylindrical shaft 40 cease to rotate in unison, the heat resistant bushings 50, 50' and the retaining rings 70, 70' always rotate in unison because the heat resistant bushing 50, 50' and the retaining ring 70, 70' are engaged with each other so as to be able to rotate in unison around the cylindrical shaft 40.

Accordingly, it is possible to reliably prevent increases in the internal diameter of the heat resistant bushing 50, 50' resulting from the surface of the heat resistant bushing 50, 50' being cut by the ends of the C-shaped retaining ring 70, 70', as a result of the heat resistant bushing 50, 50' not rotating with respect to the rotation of the retaining ring 70, 70', which is brought about by the rotation of the fixing roller 30 when driven by the pressure roller 81. Thus, it is possible to reliably prevent trouble such as a heat resistant bushing 50, 50' coming off of the cylindrical shaft 40 due to increases in the internal diameter of the heat resistant bushing 50, 50', whereby the fixing roller 30 cannot be used, and as a result this contributes to reductions in the maintenance costs for the fixing device.

Furthermore, in the mode of embodiment described above, the internal rings 61 of the ball bearings 60 are fitted on the heat resistant bushings 50, 50', whereby the fixing roller 30 can be caused to rotate smoothly around the cylindrical shaft 40 and in unison with the cylindrical shaft 40 by supporting the outer rings 62 of the ball bearings 60 at suitable places in the housing 11 of the fixing device 10.

Furthermore, because the heat resistant bushing 50, 50' has a gap 54, and the retaining ring 70, 70' has a space between the ends 71, both of which are of predetermined widths and are formed by cutting in the axial directions thereof, the heat resistant bushing 50, 50' and the retaining ring 70, 70' are able to flexibly respond to thermal expansion due to heating, by way of the presence of this gap 54 and this space, in addition to which, by flexibly deforming these at this gap 54 and this space, the retaining ring 70, 70' and the heat resistant bushing 50, 50' can easily be fitted on and removed from, the cylindrical shaft 40.

Furthermore, in the fixing roller member 20 of the first mode of embodiment, a protrusion 53 is provided on the heat resistant bushing 50 (FIG. 3A and FIG. 3B), which fits between the ends 71 of the retaining ring 70, whereby as a result of this protrusion 53 fitting between the ends 71 of the retaining ring 70, it is possible to ensure that the heat resistant bushing 50 and the retaining ring 70 rotate in unison around the cylindrical shaft 40, so that not only is the unified rotational structure of the heat resistant bushing 50 and the retaining rings 70, 70' simple, but it is possible to reliably ensure that the two always rotate in unison.

Furthermore, in the fixing roller member 20' of the second mode of embodiment, a protruding tab 73, which fits into the gap 54 in the heat resistant roller 50' is provided on one of the ends 71 of the retaining ring 70', whereby as a result of this protruding tab 73 fitting into the gap 54 in the heat resistant bushing 50', it is possible to ensure that the heat resistant bushing 50' and the retaining ring 70' rotate in unison around the cylindrical shaft 40, so that not only is the unified rotational structure of the heat resistant bushing 50' and the retaining ring 70' simple, but it is possible to reliably ensure that the two always rotate in unison.

The present invention is not limited to the embodiments described above, and includes the following concepts.

(1) In the embodiment described above, while the pressure roller member 80 is rotationally driven around an axis, the fixing roller member 20 is driven by the pressure roller member 80, by way of pressing the circumferential face of the pressure roller member 80 against the circumferential face of the fixing roller member 20, but the present invention is not limited to the fixing roller member 20 being driven by the pressure roller member 80, and a constitution may be used wherein the fixing roller member 20 is rotationally driven so that the pressure roller member 80 is driven by the fixing roller member 20.

(2) In the fixing roller member 20' of the second mode of embodiment, no protrusion corresponding to the protrusion 53 in the first mode of embodiment is provided on the flange 52 of the heat resistant bushing 50', but the present invention is not limited to a constitution wherein the protrusion 53 is not provided on the heat resistant bushing 50' of the second mode of embodiment, and a constitution wherein a protrusion 53 is provided thereon may be used (in other words, the heat resistant bushing 50 of the first mode of embodiment may be used in the second mode of embodiment without modification).

(3) In the modes of embodiment described above, an annular groove 41 is provided on the cylindrical shaft 40 in order to stop the retaining ring 70 from coming off, but the present invention is not limited to a constitution wherein the retaining ring 70 is prevented from coming off by the annular groove 41, and a constitution may be used wherein a plurality of retaining protrusions, oriented in the outward radial direction, are provided on the circumferential face of the cylindrical shaft 40.

What is claimed is:

1. A fixing device comprising:

a housing;

a roller being mounted in the housing, the roller being configured to perform a fixing process on a paper having a transport toner image;

a bushing being fitted on an end of the roller, the bushing being rotatably supported on the roller, the bushing having a gap, the bushing having a C shape; and a retaining ring being configured to fit into a roller axle and to prevent the bushing from separating from the roller and being configured to rotate in unison around the roller axle.

2. The fixing device recited in claim 1, wherein the retaining ring has a gap of a predetermined width, which is formed by cutting in the axial directions thereof.

3. The fixing device recited in claim 1, wherein the bushing includes a bushing side protrusion that fits into the gap in the retaining ring.

4. The fixing device recited in claim 1, wherein the retaining ring includes a retaining side protrusion that fits into the gap in the bushing.

5. The fixing device recited in claim 1, wherein the retaining ring has a C shape.

6. A fixing device comprising:

a housing;

a roller being mounted in the housing, the roller being configured to perform a fixing process on a paper having a transport toner image;

a bushing being fitted on an end of the roller, the bushing being rotatably supported on the roller, the bushing having a gap, the bushing having a C shape; and a bearing having an inner ring and an outer ring, configured to rotatably support the roller axle on the housing, and inner side of the bearing is fitted on the outer ring of the bushing.

7. An image forming device comprising:

an image forming unit being configured to form an image on a paper;

a housing;

a roller having a roller axle supported by the housing, the roller being configured to transport the paper;

a bushing being fitted on an end of the roller, the bushing being rotatably supported on the roller, the bushing having a gap, the bushing having a C shape; and a retaining ring being configured to fit into a roller axle and to prevent the bushing from separating from the roller and being configured to rotate in unison around the roller axle.

8. The image forming device recited in claim 7, wherein the retaining ring has a C shape.

* * * * *